US005913546A

United States Patent [19]

Kuchenbrod et al.

[11] Patent Number: 5,913,546

[45] Date of Patent: Jun. 22, 1999

[54] STUD ALIGNMENT TOOL AND METHOD OF USE

[75] Inventors: Jerry W. Kuchenbrod, Armstrong; Gary W. Kuchenbrod, Pesotum; Roger M. Fitz-Gerald, Champaigne, all of Ill.

[73] Assignee: Flight-X Corporation, Savoy, Ill.

[21] Appl. No.: 08/998,567

[22] Filed: Dec. 29, 1997

[51] Int. Cl.[6] ..... B23Q 3/00

[52] U.S. Cl. ..... 29/464; 29/271; 33/645; 269/904

[58] Field of Search ..... 29/464, 468, 559, 29/271; 52/745.15, 745.16; 33/613, 194, 645, 562; 269/904

[56] References Cited

U.S. PATENT DOCUMENTS

| | | | |
|---|---|---|---|
| 2,686,960 | 8/1954 | Le Roy | 269/904 |
| 3,201,874 | 8/1965 | Christy . | |
| 3,753,566 | 8/1973 | Nix . | |
| 4,223,494 | 9/1980 | Wendt | 52/741 |
| 4,805,364 | 2/1989 | Smolik | 52/741 |
| 4,989,336 | 2/1991 | Hawkes . | |
| 4,997,172 | 3/1991 | Mumm . | |
| 5,054,755 | 10/1991 | Waltrip . | |
| 5,148,605 | 9/1992 | Julia | 269/43 |
| 5,163,233 | 11/1992 | Benson | 33/545 |
| 5,348,274 | 9/1994 | Breen | 269/904 |
| 5,388,813 | 2/1995 | Arsenault | 269/904 |
| 5,628,119 | 5/1997 | Bingham et al. | 33/613 |
| 5,768,830 | 6/1998 | Kelly | 269/904 |
| 5,771,644 | 7/1998 | Kidd | 52/745.15 |
| 5,785,306 | 7/1998 | Wilson et al. | 269/904 |

*Primary Examiner*—David P. Bryant
*Attorney, Agent, or Firm*—Knechtel, Demeur & Samlan

[57] ABSTRACT

A one piece door framing tool for use in aligning metal wall studs within a steel doorway is disclosed. The invention comprises two longitudinal spacer legs sized to fit snugly around a metal wall stud. The spacer legs are joined together by two cross members. The first cross member joins the spacer legs together at one of their ends and the second cross member joins the spacer legs together at approximately the halfway point along their length. The first cross member and the space created between the first and second cross member create a handle for using the device. The second cross member also has a radius cut into it near its junction with each spacer leg. The radii permit lips protruding from a steel wall stud to fit within the radii, thereby allowing the metal wall stud edge of the second cross member to come into flush contact with the metal wall stud face. The free ends of the spacer legs may be tapered for use in guiding the studs into the door frame. The bottom of the spacer legs are provided with grooves into which lips protruding from a horizontal metal floor track may rest. Also provided is a method of use wherein the tool is snugly fit around a metal wall stud and, using the handle, the metal wall stud is maneuvered into a space within the door frame, the spacer legs of the tool serving as alignment mechanisms to create an equal gap on each side of the metal wall stud from floor to ceiling, thus permitting easier installation of wallboard.

15 Claims, 2 Drawing Sheets

STUD ALIGNMENT TOOL AND METHOD OF USE

I. TECHNICAL FIELD

This invention relates to construction tools and, more particularly, to a door framing tool for aligning metal framing studs with a steel door frame.

II. BACKGROUND OF THE INVENTION AND PRIOR ART

In recent years, the use of metal in the construction industry has been on the rise. It is not uncommon now to see steel or aluminum wall studs being used as opposed to wood. Also gaining in popularity are prefabricated metal door frames. Metal framing offers many advantages over wood: metal has more strength; metal is useful in applications where doors and walls are moved, e.g., office buildings; metal is less susceptible to expansion and contraction due to moisture; and metal can offer cost savings as it does not generally have the cost fluctuations of wood.

With the use of metal in construction comes problems and risks not seen in the use of wood. Chief among these problems and risks are alignment and injury. Alignment of metal framing is critical. Unlike wood to which a wall covering material, such as drywall, may be affixed at any location on the wood with either nails or screws, metal framing is impenetrable and, therefore, has slots through which screws must be threaded. Therefore, it is imperative that the metal framing be precisely positioned so that when the wall covering material is positioned, a screw may be threaded through the wall covering material and into a metal framing slot to securely fasten the wall framing material. Metal framing materials are much less forgiving than wood; manipulation of these materials can result in injury to the material user as a result of the sharp edges associated with metal framing materials.

Alignment devices are known in the industry. For example, U.S. Pat. No. 3,201,874 discloses and claims a self-positioning stud spacing guide. This device utilizes a pair of fixed jaws set at a predetermined distance from one another. Each jaw is then placed over a stud, and the predetermined distance then calibrates the distance between studs.

In U.S. Pat. No. 3,753,566, a doorjamb jig is disclosed and claimed. This device sets a door frame so that the door frame will be plumb in both the vertical and horizontal directions.

U.S. Pat. No. 4,989,336 discloses and claims a trim positioning device. This device is limited to positioning trim around a door and has no applicable use for positioning a stud between two frame members.

U.S. Pat. No. 4,997,172 discloses and claims a stud positioning tool for use in positioning a horizontal stud with respect to a perpendicular stud. This particular device cannot be used to position a stud with respect to a door frame.

Finally, U.S. Pat. No. 5,054,755 discloses and claims a stud hanger mounting tool. This device is used to position stud hangers on a header beam. It does not provide for spacing the stud hangers at a preset distance from one another nor does it function as a tool to set the spacing distance of a stud from sidewalls of a frame member to allow drywall to be placed between the stud and frame member.

As illustrated by the above prior art, to date no tool for positioning a metal wall stud within a door frame has been developed. Specifically, the prior art is devoid of an apparatus which permits precision alignment of a door frame creating the spacing needed for application of an exterior or interior wall mounting material. Additionally, the prior art is devoid of an apparatus which permits such alignment while, at the same time, reduces the risk of injury to a user.

There is need, therefore, for a simple, easy to use stud alignment tool which permits alignment of a metal wall stud within a door frame. There is need for such a device which aligns the metal wall stud within the door frame so that an outer wall surface covering material can be precisely applied. Further, such a device should reduce the risk of injury from attempting to align a steel door frame and metal wall stud.

III. OBJECTS OF THE INVENTION

It is therefore an object of the present invention to provide a one piece stud alignment tool for use in aligning metal wall studs with a door frame, particularly for application with a metal door frame or window frame.

It is another object of the present invention to provide such an alignment tool that can also be used with a variety of materials such as wood or plastic.

It is another object of the present invention to provide such an alignment tool which spaces a metal wall stud and door frame so that an outer surface wall-covering material may be precisely positioned and applied.

It is a further object of the invention to provide a door alignment tool that is inexpensive to manufacture, easy to use, and reduces the risk of injury to the user.

IV. SUMMARY OF THE INVENTION

The above objects are provided for in an improved door framing tool. According to the invention, the tool is a one piece member having two longitudinal spacer legs. The spacer legs are set a predetermined distance apart from one another such that they fit snug around a door frame stud. The two spacer legs are fixed at this predetermined distance apart from one another by a first cross member and a second cross member. The first cross member is coformed to the spacer legs at approximately the half way point along the longitudinal length of the spacer legs. The second cross member is coformed to the spacer legs along one of their ends. In between the first cross member and the second cross member is found a space, the space acting as a handle for the user.

At the end of the spacer legs opposite to the second cross members are the spacer leg free ends. Each spacer leg free-end may be tapered to permit easier maneuverability of the tool when setting it in place.

At the junction of the first cross member and each spacer leg is found a radius. The radii permit the device to be used in applications wherein there is a lip in the steel door frame member which the spacer legs are butted against. This permits the tool to be placed in proper position by allowing the lip found on the door frame member to slide into the radius with the first cross member abutting against the door frame member.

Grooves are located on the bottom of the tool along the longitudinal length of the spacer legs. One groove is found in each spacer leg. The grooves permit precision alignment of metal track by allowing the outer edge of the stud to fit within the groove, thereby aligning it in proper position to the door frame member which is found within the confines of the space created by the two spacer legs and the first cross member.

Application of the tool to a door frame member and a metal wall stud results in the metal wall studs being aligned with the door frame member in a precise manner so that an outer surface wall covering may be precisely positioned for fastening it to the door frame and metal wall studs.

Optionally, downwardly projecting spacer legs may be fixed to the bottom surface of the spacer legs. The downwardly projecting spacer legs allows a height adjustment to the device permitting further accuracy in alignment of the metal floor track and door frame member.

V. BRIEF DESCRIPTION OF THE DRAWINGS

VI. DESCRIPTION OF THE PREFERRED EMBODIMENT

Figure 1:
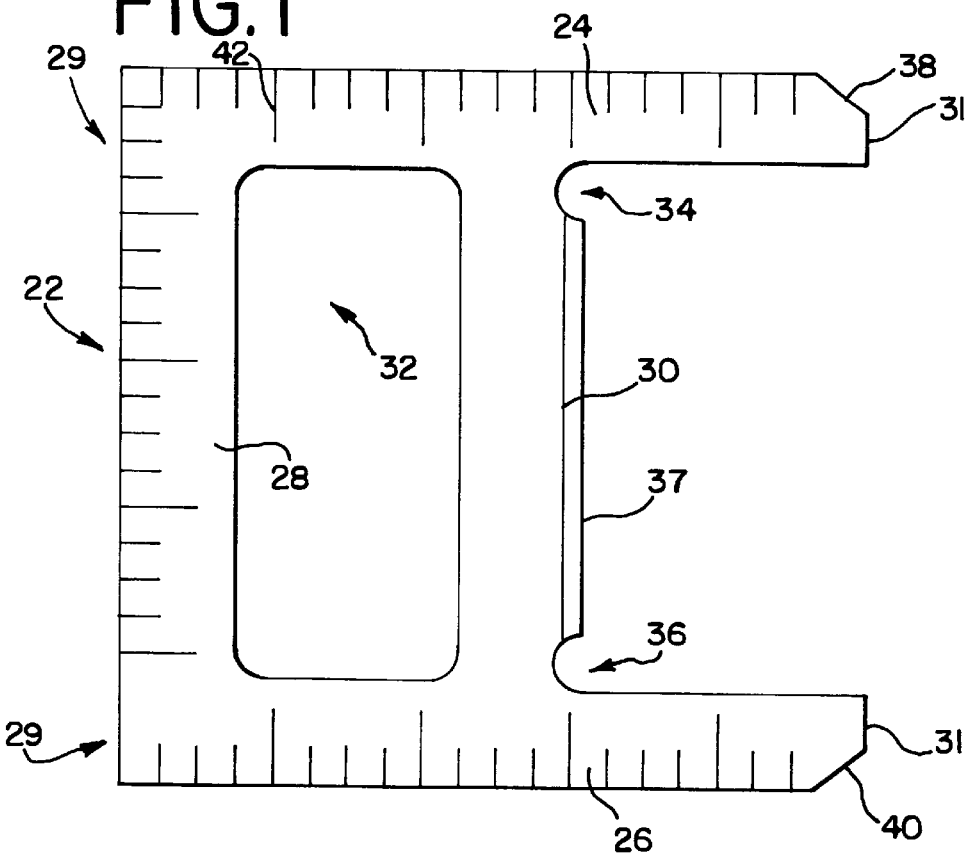
FIG. 1 illustrates a top view of the inventive device.

While the description of the preferred embodiment is directed to a door frame, it should be understood that the device is not limited to such use. For example, the device can also be used to align window frames. Moreover, the device, being ideally suited for use with metal frames, can also be used with plastic or wood frames. Turning to FIG. 1, a top view of the inventive door framing tool 22 is depicted. Tool 22 is preferably made of a rigid material such as steel or aluminum. However, other compositions may be used such as a composite or fiberglass. Extrusion molding is ideal for the manufacture of tool 22; however, many other conventional molding process can also work. Additionally, the various parts of tool 22, as described below, may be welded to one another. The only requirement for materials and manufacturing techniques is that the various spaces, diameters, thicknesses, and widths critical to the device's proper functioning be minimally altered by use, abuse, or temperature.

Tool 22 has two longitudinally extending spacer legs, first spacer leg 24 and second spacer leg 26. Spacer legs 24 and 26 are sized so that they can properly fit into the spaces required when door frame alignment is taking place (more fully described below). While sizing must fit the use, the inventors found that a spacer leg width of 0.50" is preferable for most applications.

Spacer legs 24 and 26 are permanently affixed to first cross member 28 and second cross member 30 at a predetermined distance apart from one another such that spacer legs 24, 26 will fit around a metal wall stud (not shown) for insertion into a door frame (not shown). As with the spacer leg width, the distance between spacer legs is governed by a particular application. Under current building standards a 3.82" width is most desirable. First cross member 28 is perpendicularly joined to spacer legs 24, 26 at one end 29 of spacer legs 24, 26.

Second cross member 30 is also affixed to spacer leg 24, 26 in perpendicular fashion. Second cross member 30 is affixed to the spacer legs at a distance along the longitudinal length of spacer legs 24, 26 such that the free ends 31 of spacer legs 24, 26 can fit around a metal wall stud and extend beyond it a distance of approximately ⅛ to ½ inch. The inventors found the optimal length to be 1.92". Second cross member 30 is permanently affixed in this position to spacer legs 24, 26.

The space 32 created between first cross member 28 and second cross member 30 permits first cross member 28 to work as a handle for operating the device. The most efficient manner in manufacture tool 22 is to have spacer bars 24, 26 parallel to one another along their entire length. However, it is only important that they be parallel to each other between second cross member 30, stud edge 37, and free ends 31. The spacer bar length between stud edge 37 and cross member 28 may be of an alternate configuration, for example, tapered or rounded. Also, space 32 and second cross member 28 are not critical. Thus, any configuration in which tool 22 may be grasped for operating it may be utilized. Additionally, first cross member 28 could be coated with a non-slip product such as urethane, to help prevent slipping.

Near the junction of second cross member 30 and spacer legs 24, 26 are found radii 34, 36. Radii 34, 36 permit use of the device in situations in which the metal wall stud has a protruding lip. Radii 34, 36 permit the metal wall stud's lip (not shown) sufficient space so that they do not interfere with stud edge 37 of second cross member 30 from coming in contact with the stud.

Free ends 31 of spacer legs 24, 22 can be squared, rounded or tapered, with tapered ends bearing the preferred embodiment. Tapered ends 38, 40 permit easy maneuverability of device 22 when attempting to insert a metal wall stud into a door frame configuration (more fully described below). Indices 42 may optionally be included on the surface of tool 22 to assist in the alignment process or serve as a measuring aid. The inventive device may also include a magnet for removably attaching the device to a metal stud.

Figure 2:
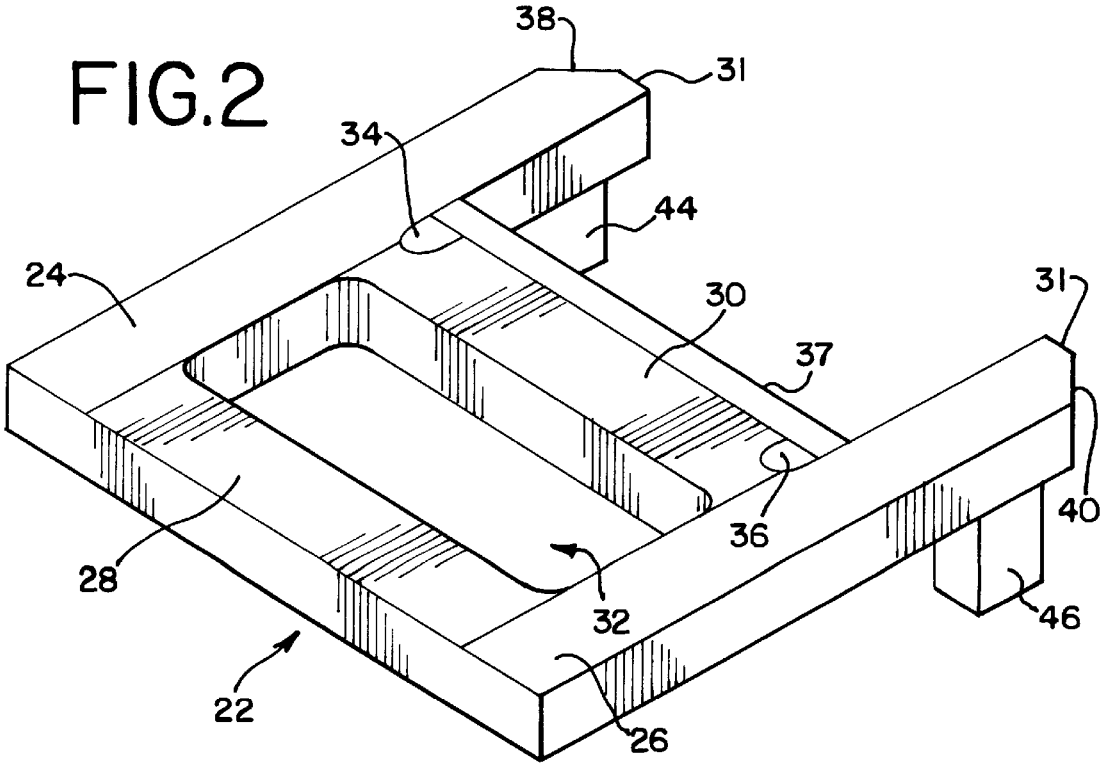
FIG. 2 illustrates a bottom view of the inventive device.

Turning to FIG. 2, a top perspective view, optional downwardly extending spacer legs 44, 46 are depicted. Downwardly projecting spacer legs 44, 46 are affixed perpendicularly to the bottom of spacer legs 24, 26. Downwardly projecting spacer legs 44, 46 can be used to assist in keeping tool 22 level when it is used low near the ground or high near the top of a door frame, thus insuring that the metal floor track is being placed into the door frame in a straight position.

Figure 3:
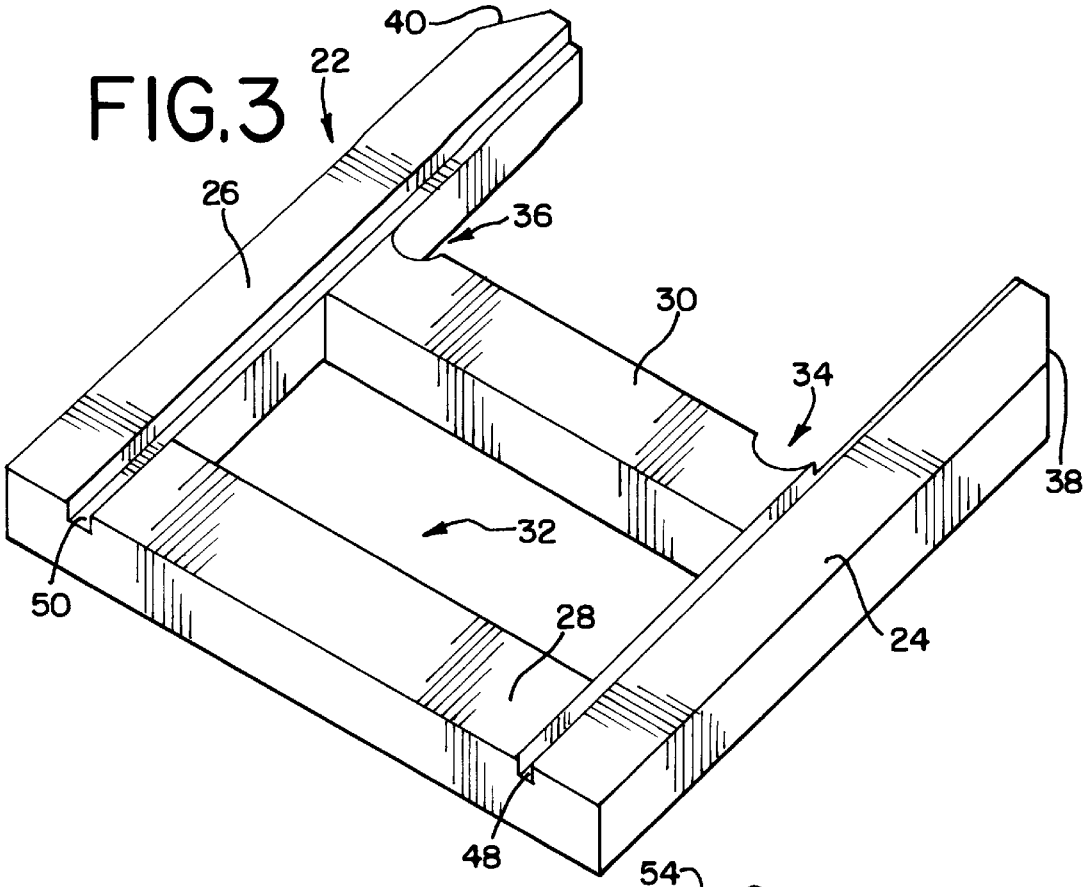
FIG. 3 illustrates a perspective view of the inventive device illustrating the optional downwardly projecting spacer legs.

Turning to FIG. 3, a bottom perspective view of tool 22 illustrates grooves 48, 50. Grooves 48, 50 are made along the longitudinal length of spacer legs 24, 26 near their edge closest to cross members 28, 30. Grooves 48, 50 permit use of the tool in an alternate embodiment in which a horizontal metal floor track 51 near the bottom of a door frame has a lip 53. The lip of the horizontal metal floor track fit into grooves 48, 50, thereby permitting accurate alignment of the tool along a horizontal metal floor track. The preferred embodiment places the grooves near the junction of the spacer legs and the cross members, but the grooves can be placed anywhere along the bottom of the spacer legs as the application requires.

Figure 4:
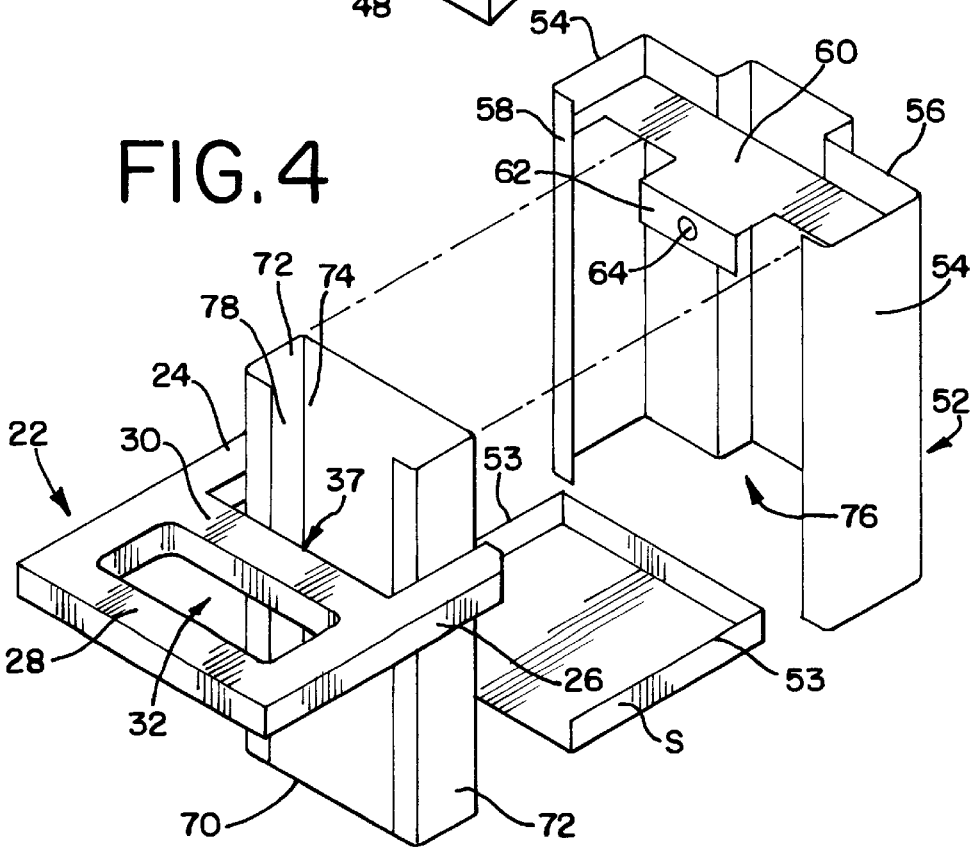
FIG. 4 illustrates a representative example of the inventive device in use.

FIG. 4 depicts use of the tool. One side of a standard vertical door frame 52 is shown. One such door frame is found on each side of the door. Door frame 52 has side walls 54, rear walls 56, and inwardly protruding legs 58, all of which extend from the floor to the top of the door.

Between side walls 54 are found horizontal pieces 60. There are several of these spaced vertically. Each horizontal piece 60 has a downwardly extending leg 62 with a central mounting hole 64. The inwardly protruding legs 58, downwardly extending leg 62, and central mounting hole 64 are all on the inner side of the building wall.

A door frame is mated with a vertical metal wall stud 70 which has two legs and 72, and two reentry arms 74. Attempting to insert vertical metal wall stud 70 into the space 76 between inwardly protruding legs 58 so that downwardly extending legs 62 and central mounting hole 64 line up properly with metal wall stud 70 is difficult. If metal wall stud 70 is not inserted into space 76 properly, the height tolerant spacing between leg 72 of vertical stud 70 will be either too far away from or too close toward inwardly protruding legs 58. Thus, the surface mounting material, such as drywall, cannot fit into the space and the metal wall stud must then be realigned until sufficient space is created along the entire length of door frame 52. This can be time consuming and the cause of injury, i.e., with cuts to the assembler.

Using tool 22, spacer legs 24, 26 fit around and abut up leg 72 to the point that radii 34, 36 engage the free ends 78 of leg 72 of vertical metal wall stud 70. Vertical metal wall stud 70 is then moved toward door frame 52 using the handle of device 22. Spacer legs 24, 26 insure that the proper spacing between legs 72 and inwardly protruding legs 58 is maintained.

The above description is for illustration purposes. The invention is to be limited only by the appended claims.

We claim:

1. A door framing tool comprising:

an essentially U-shaped member having two spacer legs joined to one another at one of their ends by a first cross member, a second cross member joined to the spacer legs at approximately half way along the length of the spacer legs, the distance between the spacer legs said to be approximately equal to the width of a stud.

2. The door framing tool of claim 1 wherein the spacer legs are parallel to each other.

3. The door framing tool of claim 1 wherein the spacer legs and cross members are coformed as an integral piece.

4. The door framing tool of claim 1 further comprising two cut out radii, one radius located near each junction of a spacer leg and the second cross member.

5. The door framing tool of claim 1 further comprising a top and a bottom to each spacer leg, and a groove along the length of the bottom of each spacer leg.

6. The door framing tool of claim 1 wherein the ends of the spacer legs opposite the first cross member are tapered.

7. The door framing tool of claim 1 and further comprising a magnet on the tool for removably attaching the tool to a metal stud.

8. The door framing tool of claim 1 and further comprising a handle formed by the first cross member and the space between the first cross member and the second cross member.

9. The door framing tool of claim 1 further comprising at least two downwardly projecting spacer legs, the downwardly projecting spacer legs being affixed to the bottom of each spacer leg and being of equal height.

10. The door framing tool of claim 1 wherein the width of the spacer legs is approximately equal to the thickness of a sheet of drywall.

11. A door frame aligning device having no moving parts comprising:

a body having two spacer bars;

a first cross member positioned perpendicular to the spacer bars and connecting them to one another at approximately halfway along the length of the spacer bars, a second cross member positioned perpendicular to the spacer bars near one end of the spacer bars and connecting the spacer bars to one another, the first cross member further having two radii, one radius formed near each junction of the first cross member and a spacer bar, the spacer bars further having a top and a bottom, the bottom of each spacer bar having a groove along its longitudinal length.

12. The door frame aligning device of claim 11 wherein the groove is formed along an edge formed by the bottom and an adjacent side wall.

13. The door frame aligning device of claim 11 further comprising at least one downwardly projecting spacer leg attached to the bottom of each of the spacer legs, the downwardly projecting spacer legs being of equal height with respect to each other.

14. A method for aligning a metal wall stud with a door frame comprising the steps of:

placing a door frame alignment apparatus having two spacer legs connected to one another at a predetermined distance apart from one another via a cross member around a metal wall stud such that each spacer leg is disposed adjacent to a respective edge of the metal wall stud;

inserting the metal wall stud and the door frame alignment apparatus into the door frame at the desired location, such that the spacer bars determine gaps formed between the metal wall stud and the door frame on both sides of the metal wall stud;

securing the metal wall stud to the door frame at that location; and removing the door frame alignment device.

15. The method of claim 14 and the further step of placing wallboard between the gaps formed between the metal wall stud and door frame.

* * * * *